US006913077B2

(12) United States Patent
MacKenzie

(10) Patent No.: US 6,913,077 B2
(45) Date of Patent: Jul. 5, 2005

(54) DOWNHOLE FLUID SEPARATION SYSTEM

(75) Inventor: Gordon R. MacKenzie, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/223,402

(22) Filed: Aug. 19, 2002

(65) Prior Publication Data

US 2003/0098160 A1 May 29, 2003

Related U.S. Application Data

(60) Provisional application No. 60/333,792, filed on Nov. 28, 2001.

(51) Int. Cl.[7] ..... E21B 33/127
(52) U.S. Cl. ..... 166/186; 166/194
(58) Field of Search ..... 166/387, 186, 166/106, 194, 187

(56) References Cited

U.S. PATENT DOCUMENTS 2,681,114 A 6/1954 Conrad
2,839,142 A 6/1958 Huber
3,015,280 A * 1/1962 King ..... 417/401
3,032,116 A * 5/1962 Barry ..... 166/186
3,447,605 A 6/1969 Uliczky
5,366,019 A * 11/1994 Brooks ..... 166/387
5,718,292 A * 2/1998 Heathman et al. ..... 166/387

FOREIGN PATENT DOCUMENTS

EP 1 149 980 A2 10/2001

* cited by examiner

*Primary Examiner*—William Neuder
(74) *Attorney, Agent, or Firm*—Steven Rosenblatt

(57) ABSTRACT

A method of separating fluids that actuate a downhole tool from well fluids is disclosed. The assembly permits equalization or circulation through the running string for delivery of the downhole tool to the desired location. The circulation passage is closed and the clean fluid is displaced into the downhole tool by pressure applied to a movable barrier, At the end of the clean fluid displacement, a lateral port is opened to allow retrieval without pulling a wet string.

16 Claims, 1 Drawing Sheet

DOWNHOLE FLUID SEPARATION SYSTEM

PRIORITY INFORMATION

This application claims the benefit of U.S. Provisional Application No. 60/333,792 on Nov. 28, 2001.

FIELD OF THE INVENTION

The field of this invention relates to systems to separate incompatible fluids downhole and more particularly in the context of isolation of fluid to inflate an inflatable from the other fluids in the well bore.

BACKGROUND OF THE INVENTION

Inflatables are used downhole for a variety of applications. Typically a valve that opens responsive to applied pressure regulates the inflatable. In some applications there can be a series of valves. In either case, the valve assembly is sensitive to solids that may be present in well fluids. One example is in high-pressure wells where very dense mud formulations are required for pressure control. In these instances the mud contains a significant amount of grit that can undermine the operation of the valves on the inflatable. Another problem is settlement of solids. If solids in appreciable quantities get into the inflatable and settle out, then the inflatable will not go back down sufficiently when deflated and will present problems when it is time to retrieve it. Mixing of fill fluids and well fluids could cause a reaction that creates a very viscous emulsion or worse, a resulting compound that hardens inside the inflatable, making subsequent extraction of the inflatable difficult, if not impossible.

In the past, attempts were made to overcome this problem. One technique involved putting clean fluid, such as water above the inflatable and topping it off with a large plug of grease. The idea was that the grease plug would remain cohesive and displace the clean fluid into the inflatable, without allowing the grit laden well fluids an opportunity to reach the delicate valve system on the inflatable. This system was unreliable as the downhole temperatures may reduce the grease viscosity and allowed well fluids to get by the plug and into the inflatable. Another attempt involved a downhole pump powered with a wireline. The pump was disposed in a clean fluid and the wireline extended through a movable barrier with the well fluids on top. As the pump delivered the clean fluid to the inflatable, the well fluid acted on the barrier to push it downhole along the electric line. The problem was that the electric line had an irregular outer surface and it was difficult in some applications to obtain a good seal between the stationary electric line and the bushings in the movable barrier. Apart from that the arrangement required special equipment to run the electric line to power the pump. There were cost and physical space concerns involved in the deployment of this arrangement. Efforts to provide a regular outer surface on the electric line through the use of a smooth coating were successful in some applications but were abandoned as being too costly and unreliable in the elevated temperatures in some existing deep well applications.

Accordingly, what was needed was a simple system to separate fluids to ensure reliable inflatable operation. At the same time, the system had to accommodate running in while circulating or allowing equalization of well fluids into the string during run-in. The system would also need to allow fluid communication from inside to outside the string during retrieval to prevent pulling out a wet string, laden with the weight of well fluids internally. Ideally, the system would be simple to construct and to operate, using familiar components as much as possible and requiring no specialty equipment at the surface or complicated procedures that would necessitate specialty service company personnel or unique training for the rig hands. These benefits in a variety of combinations are some of the beneficial aspects of the present invention. These and other features of the apparatus and the methods of the present invention will be more readily appreciated by a review of the description of the preferred embodiment, which appears below.

SUMMARY OF THE INVENTION

A method of separating fluids that actuate a downhole tool from well fluids is disclosed. The assembly permits equalization or circulation through the running string for delivery of the downhole tool to the desired location. The circulation passage is closed and the clean fluid is displaced into the downhole tool by pressure applied to a movable barrier. At the end of the clean fluid displacement, a lateral port is opened to allow retrieval without pulling a wet string.

DETAILED DESCRIPTION OF THE PREFERRED EMBODIMENT

Figure 1:
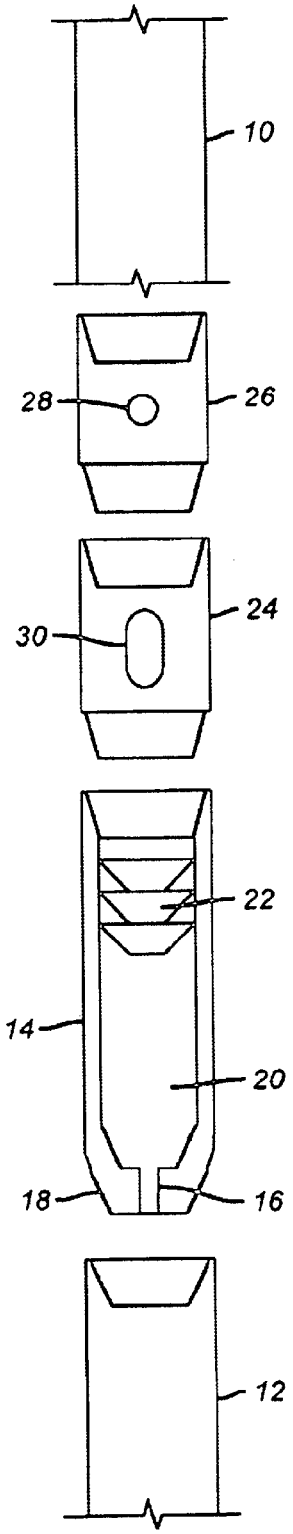
FIG. 1 is a schematic representation of the invention using a separate circulation valve.

Referring to FIG. 1, a conveyance pipe 10, which can be rigid tubing, drill pipe snubbing pipe, coiled tubing or the like is used to convey a downhole tool 12 to a desired location. The downhole tool 12 can be any one of a variety of known downhole tools, but in the preferred embodiment it is an inflatable tool. Mounted above the inflatable tool 12 is a landing/seal collar 14. It has a lower outlet 16 and connects to the inflatable with a thread 18 or a mechanism that auto-releases upon application of a predetermined pressure over and above the inflation upper pressure limit where the inflate valve closes. Using threads 18 release can occur by rotation of the string 10. Other connection and release devices may be employed without departing from the scope of the invention. Landing/seal collar 14 has a chamber 20 filled with a clean fluid at the surface. The volume used is preferable about 125% or more of the anticipated necessary volume to fully activate the inflatable 12. A wiper plug or dart of known construction 22 is inserted above the fluid in chamber 20. Other movable barriers, which seal peripherally, are also contemplated. Wiper plugs or darts are used commonly in casing cementing operations to isolate cement from other well fluids as those well fluids push on the wiper or the dart to displace cement to the annular space around the casing until the wiper or dart is "bumped" when it reaches a receptacle.

Mounted above the landing/seal collar 14 is a circulating valve 24 of a known construction such as models H300-55 or H330-51 made by Baker Oil Tools. Above that is a fill up sub 26 of known construction such as models H330-78 or H300-98 made by Baker Oil Tools. The incompatible well fluid is disposed above the wiper 22.

This embodiment of the system operates in the following manner. As the inflatable 12 is lowered to the desired depth, an aperture 28 on the fill up sub 26 is open. This allows well fluid to enter the tubing 10 as it is lowered in the well and also allows circulation, if necessary. When the desired depth is reached, a ball (not shown) is dropped into the fill up sub to essentially close off aperture 28 while at the same time allowing flow around the ball to permit the application of applied fluid pressure onto the wiper 22. Well fluids pushing on wiper 22 reduce the volume of chamber 20, as clean fluid is displaced into the inflatable 12 through lower outlet 16. After the inflatable 12 is set and released such as by undoing thread 18, for example, the wiper is landed in the bottom of the landing/seal collar 14. Thereafter, pressure is built up above the wiper 22 and in circulating valve 24. There is a piston (not shown) inside the circulating valve 24, which is responsive to applied pressure to shift positions and expose a port 30. With port 30 open, the tubing 10 can be pulled and it will drain so that a wet string is not created which could overtax the surface equipment used to pull it up or to allow for further displacement of fluids such as cement. It should be noted that aperture 28, once closed by the dropping of a ball, remains closed for the duration of the procedure. The circulation valve 24 is needed because the isolating mechanism, which comprises the wiper 22, prevents draining the tubing 10 during removal. Surface personnel will see a pressure spike as the wiper 22 bottoms, followed by a quick drop in pressure as the port 30 is opened.

Figure 2:
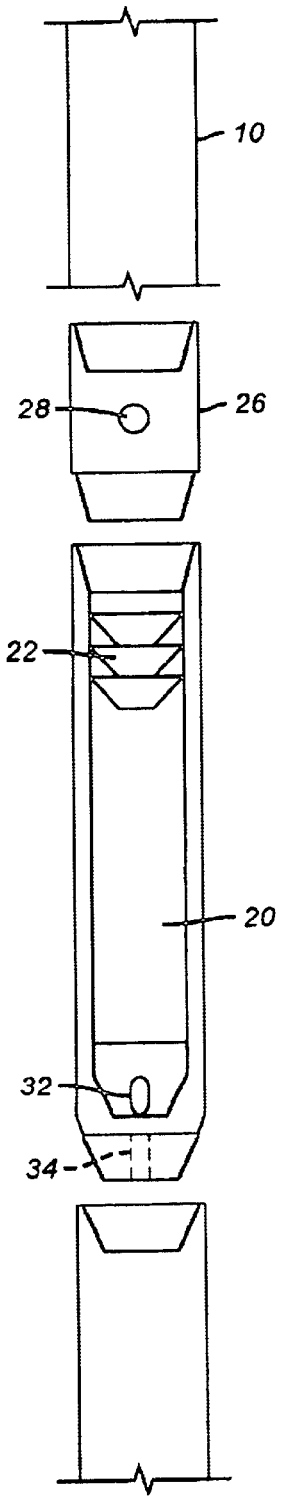
FIG. 2 is a schematic representation of the invention using an integrated circulation valve.
Figure 3:
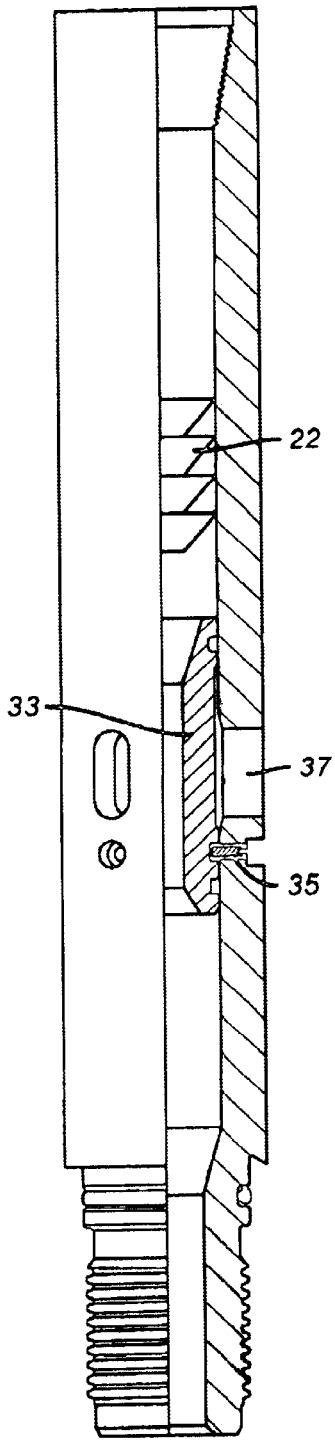
FIG. 3 is an alternative embodiment to FIG. 2.

The alternative method is shown in FIG. 2. It differs from the FIG. 1 method in that a separate circulating valve 24 has been moved from the position below the fill up sub 26 to a lower position inside chamber 20. The steps to set and release the inflatable 12 in FIG. 2 are identical with the FIG. 1 operation. The difference lies in the pressurization above the wiper 22 after release from the inflatable 12. As the wiper 22 moves downwardly, it physically engages the relocated circulation valve 24 and shifts a sleeve (not shown) that is internal to the circulation valve until a port 32 aligns with a port 34 on the housing of the landing/seal collar 14. The string can now drain as it is being pulled out of the hole. FIG. 3 shows a similar concept except a sleeve 33 is held by shear pin 35 to initially cover aperture 37. The wiper 22 eventually displaces sleeve 33 to allow the string to drain during removal.

Those skilled in the art can appreciate that the apparatus and method of the invention is simple and inexpensive and offers a reliable technique to isolate clean fluid for use in an inflatable or other downhole tool, while at the same time allowing the tubing to fill automatically during run in and drain during retrieval from the wellbore. Many different movable barriers are contemplated to sealing separate the clean fluid from the surrounding well fluid. Use of known components, reduces costs, and insures more reliable operation due to familiarity with the equipment by rig personnel.

The above description is illustrative of the preferred embodiment and many modifications may be made by those skilled in the art without departing from the invention whose scope is to be determined from the literal and equivalent scope of the claims below:

I claim:

1. An isolation system to isolate well fluids from inflation valving of an inflatable, comprising:

a housing defining a cavity, said housing connected to the valving on the inflatable such that said cavity is in fluid communication with the valving;

inflation medium in said housing in sufficient quantity to fully inflate the inflatable when displaced, at least in part, through the valving of the inflatable; and an impermeable movable barrier capable of isolating well fluids from said cavity as said barrier is displaced and said inflation medium is displaced through said valving.

2. The system of claim 1, wherein:

said barrier comprises a wiper plug.

3. The system of claim 1, wherein:

said barrier comprises a dart.

4. The system of claim 1, wherein:

said barrier seals substantially along an outer periphery thereof.

5. The system of claim 1, further comprising:

a circulating sub including a drain port covered by a valve member, whereupon movement of said barrier actuates, at least in part, said valve member to expose said port for fluid draining from said housing as it is removed from a wellbore.

6. An isolation system to isolate well fluids from inflation valving of an inflatable, comprising:

a housing defining a cavity, said housing connected to the valving on the inflatable such that said cavity is in fluid communication with the valving;

inflation medium in said housing in sufficient quantity to fully inflate the inflatable when displaced, at least in part, through the valving of the inflatable; and an impermeable movable barrier capable of isolating well fluids from said cavity as said barrier is displaced and said inflation medium is displaced through said valving;

said housing further comprises a fill up sub to provide an open lateral port above said barrier when said housing is run in.

7. The system of claim 6, wherein:

said fill up sub comprises a valve member that is moved over said lateral port to direct pressure to said barrier for displacement thereof.

8. The system of claim 7, wherein:

said valve member is moved by fluid pressure.

9. An isolation system to isolate well fluids from inflation valving of an inflatable, comprising:

a housing defining a cavity, said housing connected to the valving on the inflatable such that said cavity is in fluid communication with the valving;

inflation medium in said housing in sufficient quantity to fully inflate the inflatable when displaced, at least in part, through the valving of the inflatable; and an impermeable movable barrier capable of isolating well fluids from said cavity as said barrier is displaced and said inflation medium is displaced through said valving;

a circulating sub including a drain port covered by a valve member, whereupon movement of said barrier actuates, at least in part, said valve member to expose said port for fluid draining from said housing as it is removed from a wellbore;

said barrier is driven against a travel stop in said housing to allow pressure buildup above it to actuate said valve member to move to expose said drain port.

10. The system of claim 9, wherein:

said housing is disconnected from the inflatable before said barrier is driven to said travel stop.

11. An isolation system to isolate well fluids from inflation valving of an inflatable, comprising:

a housing defining a cavity, said housing connected to the valving on the inflatable such that said cavity is in fluid communication with the valving;

inflation medium in said housing in sufficient quantity to fully inflate the inflatable when displaced, at least in part, through the valving of the inflatable; and an impermeable movable barrier capable of isolating well fluids from said cavity as said barrier is displaced and said inflation medium is displaced through said valving;

a circulating sub including a drain port covered by a valve member, whereupon movement of said barrier actuates, at least in part, said valve member to expose said port for fluid draining from said housing as it is removed from a wellbore;

said barrier engages said valve member to move away from said drain port to open it.

12. The system of claim 11, wherein:

said valve member and said drain port are within said cavity in said housing defined by the position of said barrier before it is moved within said housing.

13. An isolation system to isolate well fluids from inflation valving of an inflatable, comprising:

a housing defining a cavity, said housing connected to the valving on the inflatable such that said cavity is in fluid communication with the valving;

inflation medium in said housing in sufficient quantity to fully inflate the inflatable when displaced, at least in part, through the valving of the inflatable; and an impermeable movable barrier capable of isolating well fluids from said cavity as said barrier is displaced and said inflation medium is displaced through said valving;

a circulating sub including a drain port covered by a valve member, whereupon movement of said barrier actuates, at least in part, said valve member to expose said port for fluid draining from said housing as it is removed from a wellbore;

said housing further comprises a fill up sub to provide an open lateral port above said barrier when said housing is run in.

14. The system of claim 13, wherein:

said fill up sub comprises a second valve member that is moved over said lateral port to direct pressure to said barrier for displacement thereof.

15. The system of claim 14, wherein:

said barrier comprises a wiper plug.

16. The system of claim 14, wherein:

said barrier comprises a dart.

* * * * *